US009138022B2

(12) United States Patent
Walker

(10) Patent No.: US 9,138,022 B2
(45) Date of Patent: Sep. 22, 2015

(54) WEARABLE WINDOW POCKETS FOR WIRELESS DEVICES

(76) Inventor: Susan B. Walker, Atlanta, GA (US)

( * ) Notice: Subject to any disclaimer, the term of this patent is extended or adjusted under 35 U.S.C. 154(b) by 568 days.

(21) Appl. No.: 13/316,495

(22) Filed: Dec. 10, 2011

(65) Prior Publication Data

US 2012/0144557 A1 Jun. 14, 2012

Related U.S. Application Data

(60) Provisional application No. 61/459,249, filed on Dec. 10, 2010, provisional application No. 61/572,018, filed on Jul. 11, 2011.

(51) Int. Cl.
*A41D 23/00* (2006.01)
*A41D 27/20* (2006.01)

(52) U.S. Cl.
CPC ..... *A41D 27/205* (2013.01); *A41D 23/00* (2013.01)

(58) Field of Classification Search
CPC . A41D 23/00; A41D 27/205; A41D 13/0012; A41D 2023/00; A41D 2023/004; A41D 1/04; A41D 3/08; A41D 25/00; A41D 25/005; A41D 27/20; A41D 27/208; A45C 11/38; A45C 2011/002; A45C 2011/003; A45F 2200/0525; A42B 5/00
USPC ..... 2/207, 247, 48, 50, 51, 91, 94, 115, 2/49.2; 224/600, 603, 607
See application file for complete search history.

(56) References Cited

U.S. PATENT DOCUMENTS

| | | | | | |
|---|---|---|---|---|---|
| 1,467,680 | A | * | 9/1923 | Oda | 40/725 |
| 1,936,045 | A | * | 11/1933 | Bachrach | 2/91 |
| D142,469 | S | * | 10/1945 | Brodigan | D2/500 |
| 2,589,409 | A | * | 3/1952 | Leichter | 40/586 |
| 2,870,448 | A | * | 1/1959 | Rosenthal | 2/91 |
| 3,055,133 | A | * | 9/1962 | Anderson | 40/586 |
| 4,202,053 | A | * | 5/1980 | Bell | 2/84 |
| D315,640 | S | * | 3/1991 | Pelzel | D3/230 |
| 5,632,044 | A | * | 5/1997 | Sloot | 2/102 |
| 5,802,613 | A | * | 9/1998 | Marshall | 2/145 |
| 7,204,398 | B1 | * | 4/2007 | Smith, Sr. | 224/607 |
| D673,135 | S | * | 12/2012 | Marcin | D14/205 |
| D695,490 | S | * | 12/2013 | Lake | D2/502 |
| 2007/0033706 | A1 | * | 2/2007 | Kuhlmann | 2/207 |
| 2008/0017678 | A1 | * | 1/2008 | Anderson et al. | 224/221 |
| 2010/0125931 | A1 | * | 5/2010 | Arakelian | 2/207 |
| 2010/0287677 | A1 | * | 11/2010 | Alexander | 2/50 |
| 2010/0299800 | A1 | * | 12/2010 | Jackson, Jr. | 2/69 |
| 2010/0325767 | A1 | * | 12/2010 | Crimi et al. | 2/50 |

(Continued)

FOREIGN PATENT DOCUMENTS

CN 202680598 U * 1/2013

*Primary Examiner* — Amy Vanatta

(74) *Attorney, Agent, or Firm* — Brient Globerman, LLC

(57) ABSTRACT

A scarf comprising: (1) a length of fabric having a first end, a second end, a front surface defining a first opening, and a rear surface defining a second opening; and (2) a pocket disposed on the length of fabric. In various embodiments, when a wireless device is disposed within the pocket in a particular position, (1) the first opening is sized to allow a user to view at least a portion of a screen of the wireless device through the first opening; (2) the second opening is adapted so that the second opening aligns with a camera lens of the wireless device; and (3) the first opening and the second opening are adapted so that the user may operate the wireless device to cause the wireless device to use the camera lens to take a photograph through the second opening.

9 Claims, 6 Drawing Sheets

(56) References Cited

U.S. PATENT DOCUMENTS

2011/0002094 A1* 1/2011 Blouin ..... 361/679.01
2011/0277219 A1* 11/2011 Demus ..... 2/247
2011/0303579 A1* 12/2011 Sanders ..... 206/701
2012/0060255 A1* 3/2012 Raviv ..... 2/69
2012/0060261 A1* 3/2012 Raviv ..... 2/252
2012/0151655 A1* 6/2012 Jarboe ..... 2/84
2012/0186000 A1* 7/2012 Raviv ..... 2/247
2014/0068832 A1* 3/2014 Jordan et al. ..... 2/69

* cited by examiner

WEARABLE WINDOW POCKETS FOR WIRELESS DEVICES

CROSS REFERENCE TO RELATED APPLICATIONS

This application claims the benefit of U.S. Provisional Application No. 61/459,249, entitled "Window pocket Accessory for Mobile Media Device," filed Dec. 10, 2010, and U.S. Provisional Application No. 61/572,018, entitled "Window pocket Accessory for Mobile Media Device," filed Jul. 11, 2011, which are hereby incorporated herein by reference.

BACKGROUND

Many people desire to have easy access to their wireless devices at any time—even when exposed to cold environments. Accordingly, there is a need for improved products for allowing users easy access to their wireless devices.

SUMMARY OF THE INVENTION

A scarf, according to various embodiments, comprises: (1) a length of fabric having a first end, a second end, a front surface defining a first opening, and a rear surface defining a second opening adjacent the first opening; and (2) a pocket adjacent the first and second openings. In various embodiments, (1) the first opening is sized to allow a user to view at least a portion of a screen of a wireless device through the first opening when the wireless device is disposed within the pocket in a particular position; (2) the second opening is adapted so that, when the wireless device is disposed within the pocket in the particular position, the second opening aligns with a camera lens associated with the wireless device; and (3) the first opening and the second opening are adapted so that when the wireless device is disposed within the pocket in the particular position, the user may operate the wireless device to cause the wireless device to use the camera lens to take a photograph through the second opening.

A scarf, according to further embodiments, comprises: (1) a length of fabric having a first end, a second end, and a front surface defining a first opening; and (2) a pocket disposed adjacent the first opening. In various embodiments, the first opening is sized to allow a user to view at least a portion of a screen of a wireless device through the first opening when the wireless device is disposed within the pocket in a particular position, and the scarf is configured to allow a user who is wearing the scarf, while the wireless device is disposed within the pocket in the particular position, to reorient the scarf from: (1) a first orientation in which an end portion of the scarf that includes the pocket is hanging substantially freely adjacent the user, and the wireless device is upside down, to (2) a second orientation in which the end portion of the scarf has been elevated and the wireless device is in a right side up orientation.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Window Pocket Scarf

Figure 1:
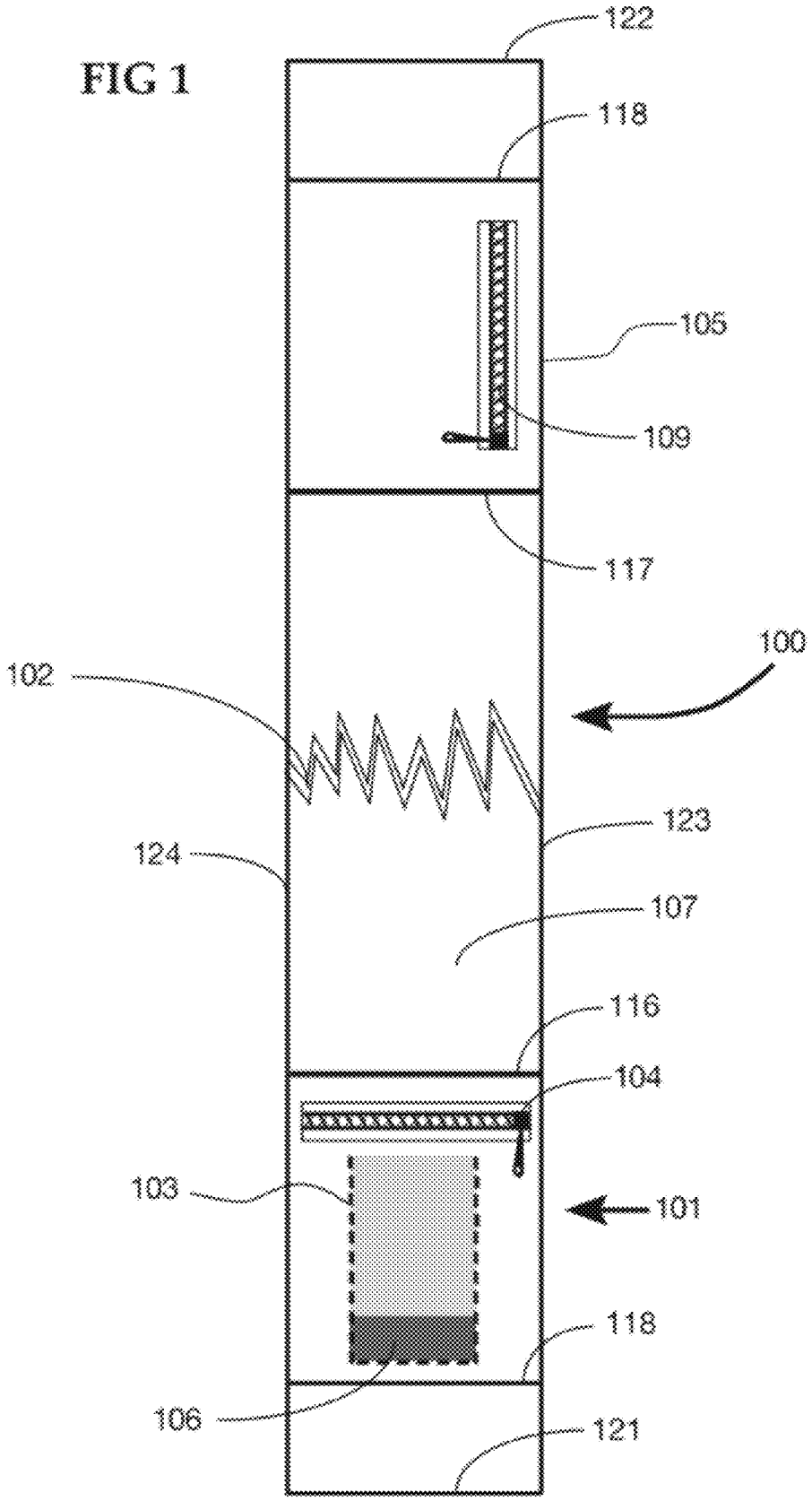
FIG. 1 is a front view of a first embodiment of a window pocket scarf.
Figure 2:
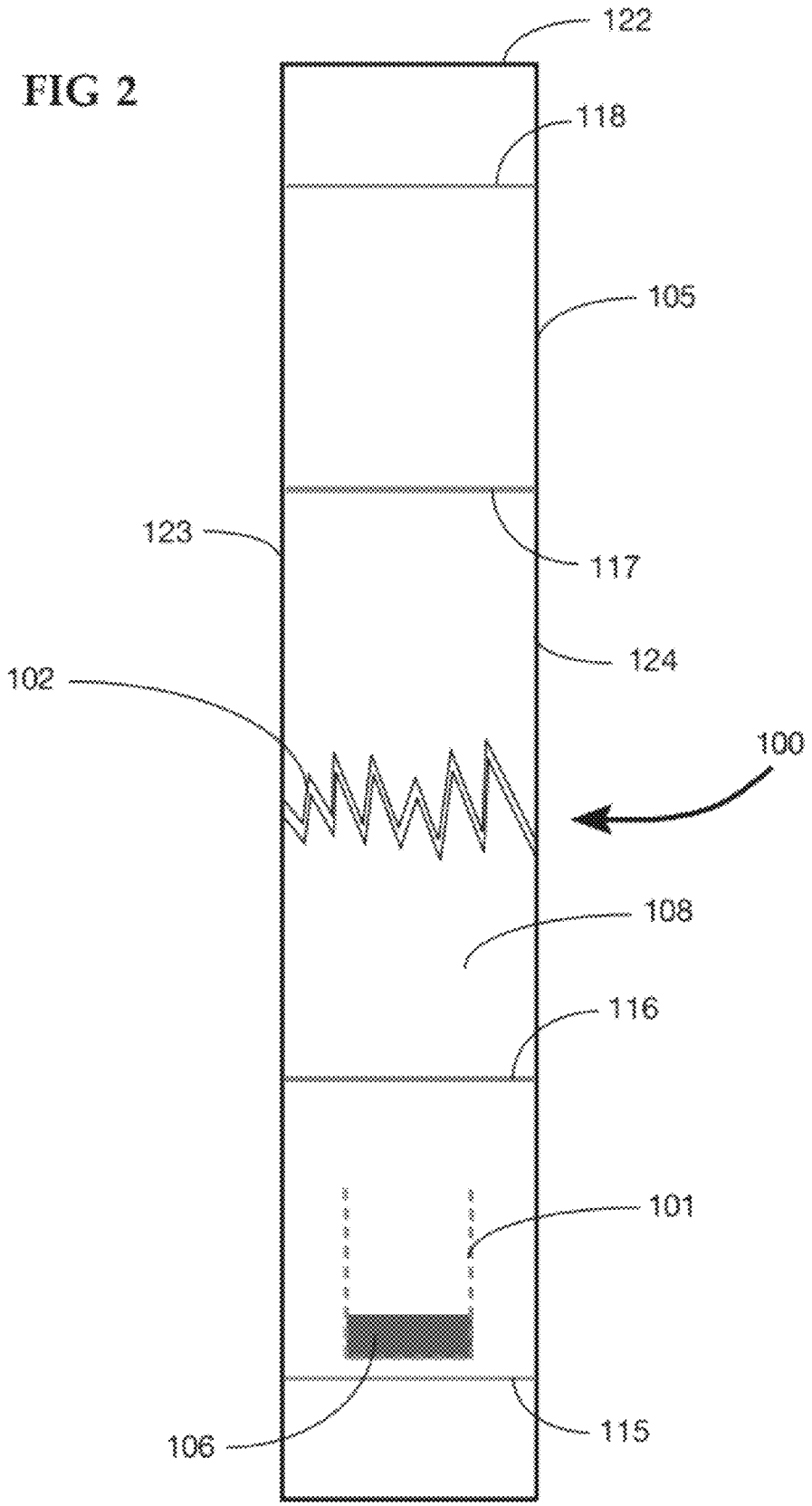
FIG. 2 is a back view of the window pocket scarf of FIG. 1.
Figure 3:
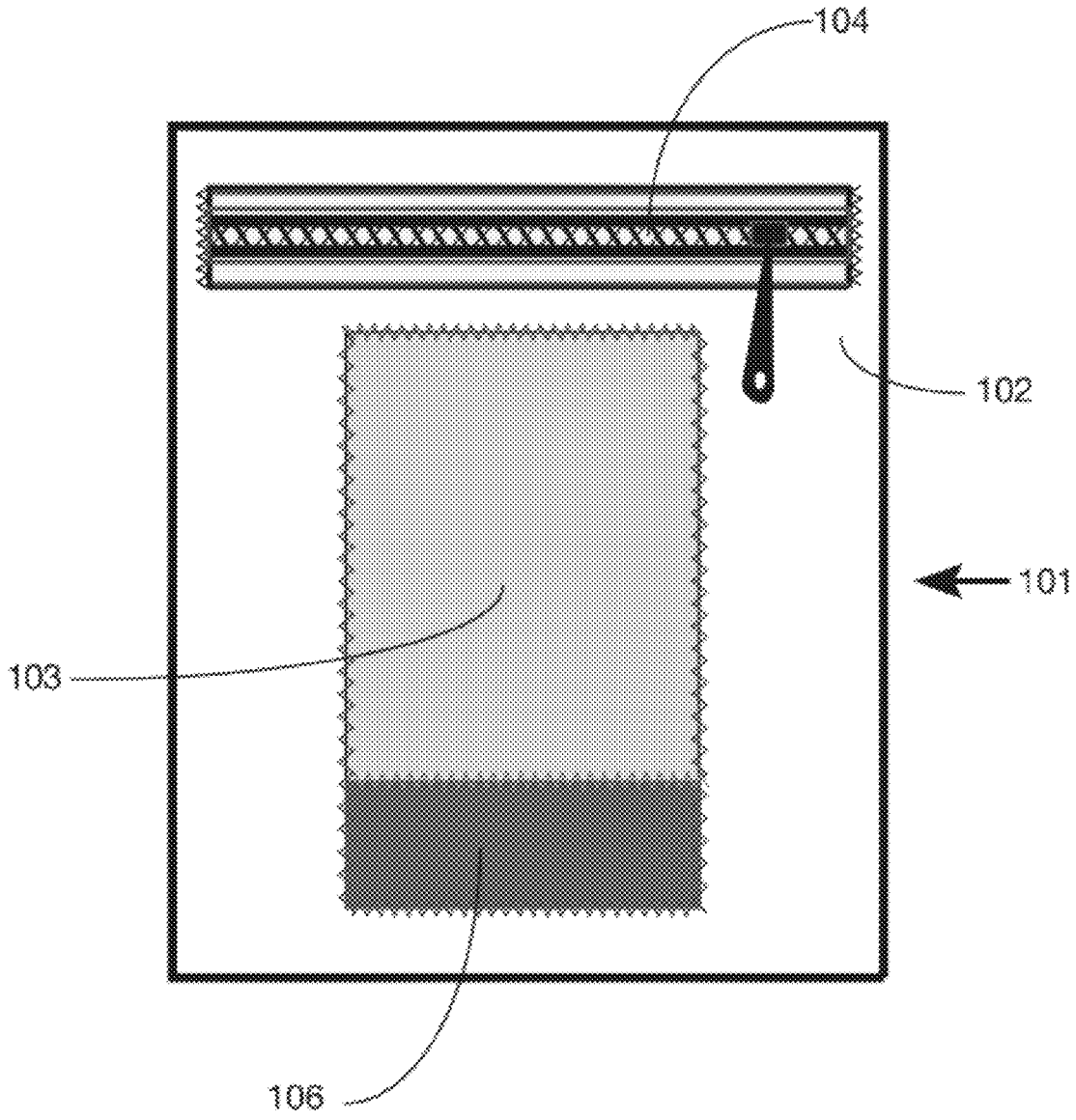
FIG. 3 is a detail view of a pocket of the window pocket scarf of FIG. 1.

A window pocket scarf 100, according to a particular embodiment, is shown in FIGS. 1 and 2. In this embodiment, the window pocket scarf 100 comprises a length of fabric 102 having a first end 121, a second end 122, a front surface 107 and a rear surface 108. In particular embodiments: (1) the scarf's front surface 107 comprises a first piece of elongated rectangular material; and (2) the scarf's rear surface 108 comprises a second piece of elongated rectangular material. The first and second elongated pieces of material may, for example, be substantially the same size and shape.

In the embodiment shown in FIG. 1, the first and second pieces of elongated rectangular material are sewn together about their respective perimeters. They also may be sewn together about one or more lateral sewing lines 115-118.

In the embodiment shown in FIG. 1, the scarf's first and second lateral sewing lines 115, 116, and first and second lateral edges 123, 124 serve as the boundaries of a pocket 101 that is defined by respective first distal portions of the scarf's front and rear surfaces 107, 108. The scarf 100 may further define an elongated access opening and a zipper 104 disposed adjacent the access opening that is adapted for selectively restricting access into an interior portion of the pocket through the elongated access opening.

In various embodiments, the length of fabric 102 may comprise any suitable material (e.g., cotton, wool, leather or any other suitable material). The length of fabric 102 may comprise a single piece of fabric or may comprise a plurality of fabric pieces constructed using any appropriate fabric fastening technique (e.g., sewing or fabric welding).

In the embodiment shown in FIG. 1, the scarf's front surface 107 defines a first opening 103. In particular embodiments, the first opening 103 may be sized to allow a user of the window pocket scarf 100 to view at least a portion of a screen of a wireless device through the first opening 103 when the wireless device is disposed within the pocket 101. In particular embodiments, the first opening 103 is defined by the front wall of the pocket 101. In certain embodiments, the first opening 103 is sized to allow a user to view substantially all (e.g., all) of the screen of a particular wireless device (e.g., an iPhone, Windows Phone, Android Phone, or any other particular wireless device) through the first opening 103.

In the embodiment shown in FIG. 1, the first opening 103 is substantially rectangular (e.g., rectangular). In this embodiment, the first opening 103 may, for example, be sized between about 3.25 and about 3.75 inches wide and between about 5.25 and about 5.5 inches tall.

In various embodiments, the first opening 103 is defined adjacent the scarf's first end 121 at least about five inches from the first end 121. In this embodiment, the distal end of the first opening 103 is substantially parallel (e.g., parallel) to the scarf's first end 121. In other embodiments, the first opening 103 may be defined on any suitable part of the scarf (e.g., it may be defined a different distance from the scarf's first end 121 and/or adjacent the scarf's second end 122).

In particular embodiments, the first opening 103 may be at least substantially covered (e.g., covered) with a first transparent material (e.g., one or more sheets of material) which may, for example, serve as a transparent window into the interior of the pocket 101. In particular embodiments, the first transparent material may be affixed adjacent (e.g., to) the scarf 100 using any appropriate fastening technique (e.g., sewing or fabric welding). In various embodiments, the first transparent material is sufficiently thin, transparent, and/or flexible to allow a user to operate a wireless device through the first transparent material while the wireless device is positioned within the pocket 101. The first transparent material may comprise any suitable material to allow a user to view the screen of and operate a wireless device through the first transparent material (e.g., PET material or vinyl).

In the embodiment shown in FIGS. 1 and 2, the scarf's rear surface 108 defines a second opening 106. In this embodiment, the second opening 106 is disposed adjacent (e.g., immediately adjacent) the first opening 103. In particular embodiments, the first and second openings 103, 106 are co-facing.

In particular embodiments, the second opening 106 may be adapted to at least substantially align (e.g., align) with the sides of the first opening 103 and may also be adapted to at least substantially align (e.g., align) with a lens of a camera of a wireless device disposed within the pocket 101. In various embodiments, the second opening 106 may be defined adjacent the first opening 103 such that when the second opening 106 is substantially aligned (e.g., aligned) with the lens of a camera of a wireless device positioned within the pocket 101, the first opening 103 is substantially aligned (e.g., aligned) with a screen of the wireless device.

In the embodiment shown in FIG. 1, the second opening 106 is sized smaller than the first opening 103 and is defined adjacent (e.g., immediately adjacent) a distal end of the first opening 103. In other embodiments, the first opening 103 and the second opening 106 may be substantially the same (e.g., the same) size and have substantially the same vertical and/or lateral alignment on opposite sides of the scarf 100. In other embodiments, the second opening 106 may be sized larger than the first opening 103.

In particular embodiments, the second opening 106 may be substantially covered (e.g., covered) by a second transparent material. The second transparent material may, for example, be affixed to the length of fabric 102 using any appropriate fastening technique (e.g., sewing or fabric welding). In various embodiments, the second transparent material may be adapted to not substantially interfere (e.g., not interfere) with the operation of the camera of a wireless device when a picture is taken with the camera through the second transparent material. The second transparent material may comprise any suitable material that is adapted to not substantially interfere with the operation of the camera of a wireless device when the camera is operated through the second transparent material (e.g., PET material or vinyl). In particular embodiments, the second transparent material may comprise the same material as the first transparent material.

In various embodiments, the window pocket scarf 100 may include a secondary accessory pocket 105, which may be, for example, defined by two elongated rectangular pieces of fabric that form the scarf 100 as discussed above. In the embodiment shown in FIG. 1, the secondary accessory pocket 105 is disposed adjacent the second end 122 of the scarf 100. As shown in FIG. 1, in various embodiments, the secondary accessory pocket 105 includes a zipper 109. In various embodiments, the secondary accessory pocket 105 may be adapted to hold personal items (e.g., a wallet, passport, or keys).

Exemplary Use of Window Pocket Scarf

Figure 4:
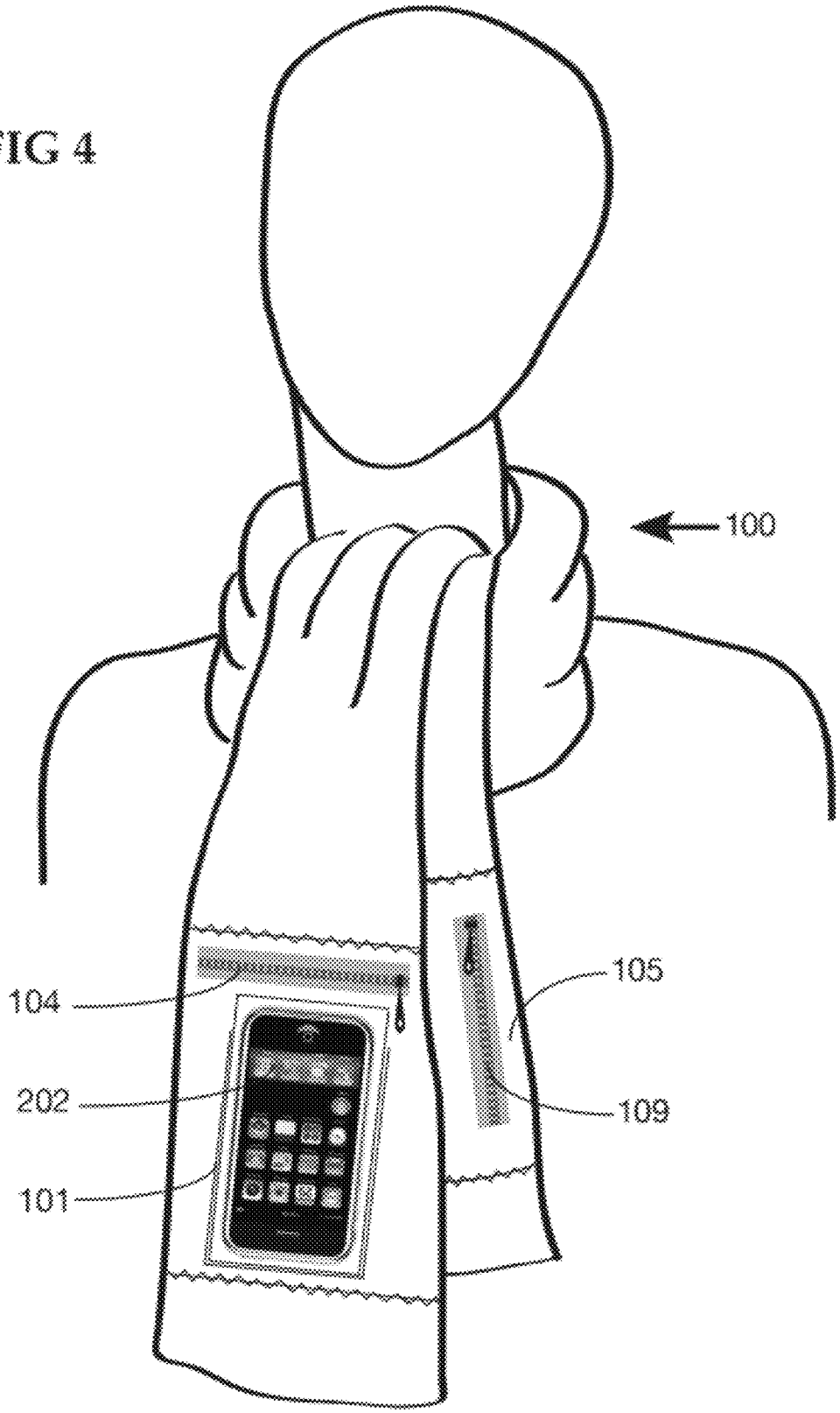
FIG. 4 is a perspective view of a user wearing the window pocket scarf of FIG. 1.

FIG. 4 shows the window pocket scarf 100 worn around the neck of a user. As may be understood from FIG. 4, a user may wear the window pocket scarf 100 around their neck in any suitable manner. For example, a user may tie the window pocket scarf 100 around their neck, wrap the window pocket scarf 100 around their neck, or wear the window pocket scarf 100 in any other suitable manner.

As shown in FIG. 4, when using the window pocket scarf 100, a user may insert a wireless device 202 into the scarf's pocket 101 by: (1) opening the zipper 104 of the scarf's first pocket 101; (2) inserting the wireless device into the pocket 101 with the wireless device's screen facing the first opening 103 and the wireless device's camera lens aligned with the second opening 106, and (3) closing the zipper 104. In embodiments in which the pocket 101 does not include a zipper 104, the user may open whatever mechanism the pocket 101 includes for opening and closing the pocket 101 or may simply insert the wireless device into the pocket 101 through a suitable opening in the pocket 101.

Once the user has inserted the wireless device into the pocket 101, the user may wear the window pocket scarf 100 as shown in FIG. 4. As may be understood from this figure, when a user is wearing the window pocket scarf 100, the pocket 101 containing the wireless device 202 may hang a distance below the user's neck. In particular embodiments, the distance may be between about one foot and about two and a half feet. In the embodiment shown in FIG. 4, the pocket 101 containing the wireless device 202 hangs at least about eighteen inches below the user's neck. In particular embodiments, the scarf's pocket 101 may be adapted to hang substantially adjacent (e.g., to) a lower portion of the user's chest.

When the user desires to operate the wireless device 202, the user may lift and reorient (e.g., flip) the wireless device 202 (while the phone remains in a relatively fixed position relative to the pocket 101) to a position in which the user is able to view and manipulate the screen of the wireless device 202 through the first opening (e.g., by touching the exterior surface of the transparent material covering the first opening 103 in a manner needed to operate a touch screen associated with the wireless device 202). When the user desires to take a photograph using the wireless device's camera, the user may simply point the wireless device's camera lens toward the object that the user wishes to photograph (e.g., while the wireless device 202 is still within the scarf's pocket 101). The user may then operate the wireless device 202 (e.g., through the material covering the scarf's first opening 103) to cause the wireless device 202 to take a photograph through the material covering the scarf's second opening 106, which may, for example, be sufficiently clear to not significantly interfere with a photograph taken through the material.

In particular embodiments, as shown in FIG. 4, the scarf 100 may be configured so that when a wireless device 202 is properly inserted into the pocket 101, the wireless device 202 is oriented upside down (e.g., so that the wireless device's display screen faces away from the user's body) when the user is wearing the window pocket scarf 100. In such embodiments, to operate the device in a right side up orientation, the user may lift and invert the wireless device 202 into a right side up orientation (e.g., in which the wireless device's display screen is facing the user) before using the device. This may, for example, allow a user to avoid re-orientating (e.g., twisting or turning) the pocket 101 excessively when operating the wireless device 202.

Alternative Embodiments

Alternative embodiments of the window pocket may comprise, for example, components that are, in some respects, similar to the various components described above. Selected distinguishing features of various alternative embodiments are discussed below.

Window Pocket Scarf without a Second Opening

In particular embodiments, a window pocket scarf may include only a first opening. In such embodiments, the window pocket scarf may be adapted to allow a user to operate a wireless device through the first opening but may not be particularly suitable for allowing the user to operate a camera associated with the wireless device while the wireless device is within the scarf's first pocket.

Window Pocket Belt

Figure 5:
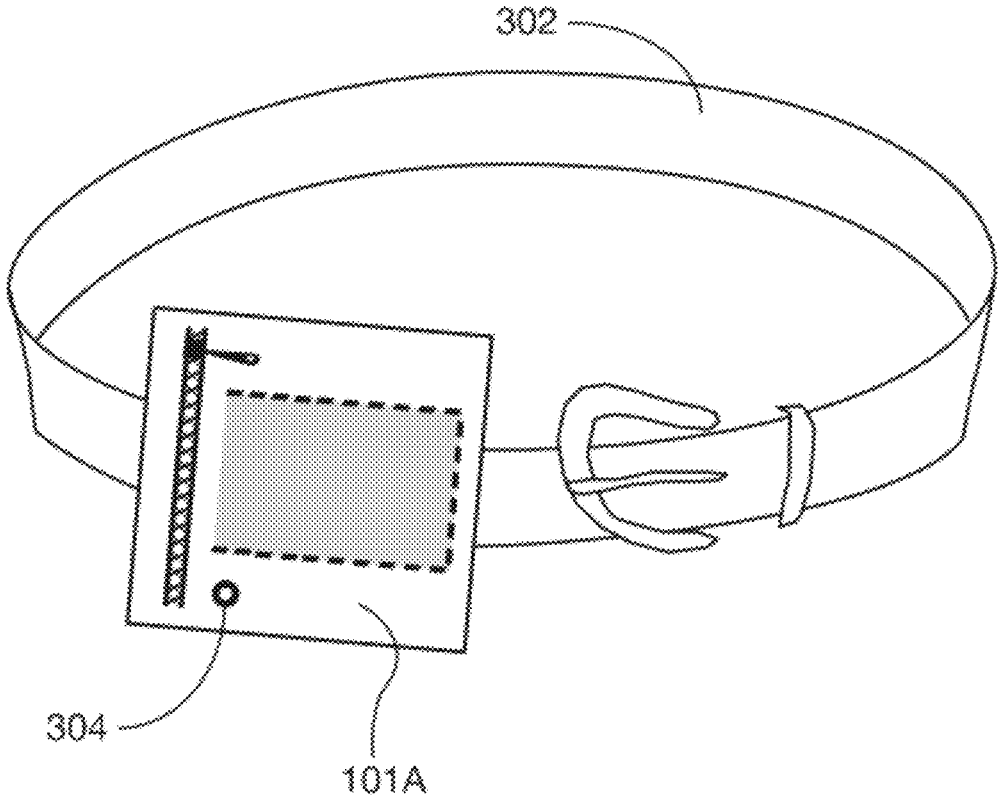
FIG. 5 is a perspective view of a window pocket belt.
Figure 6:
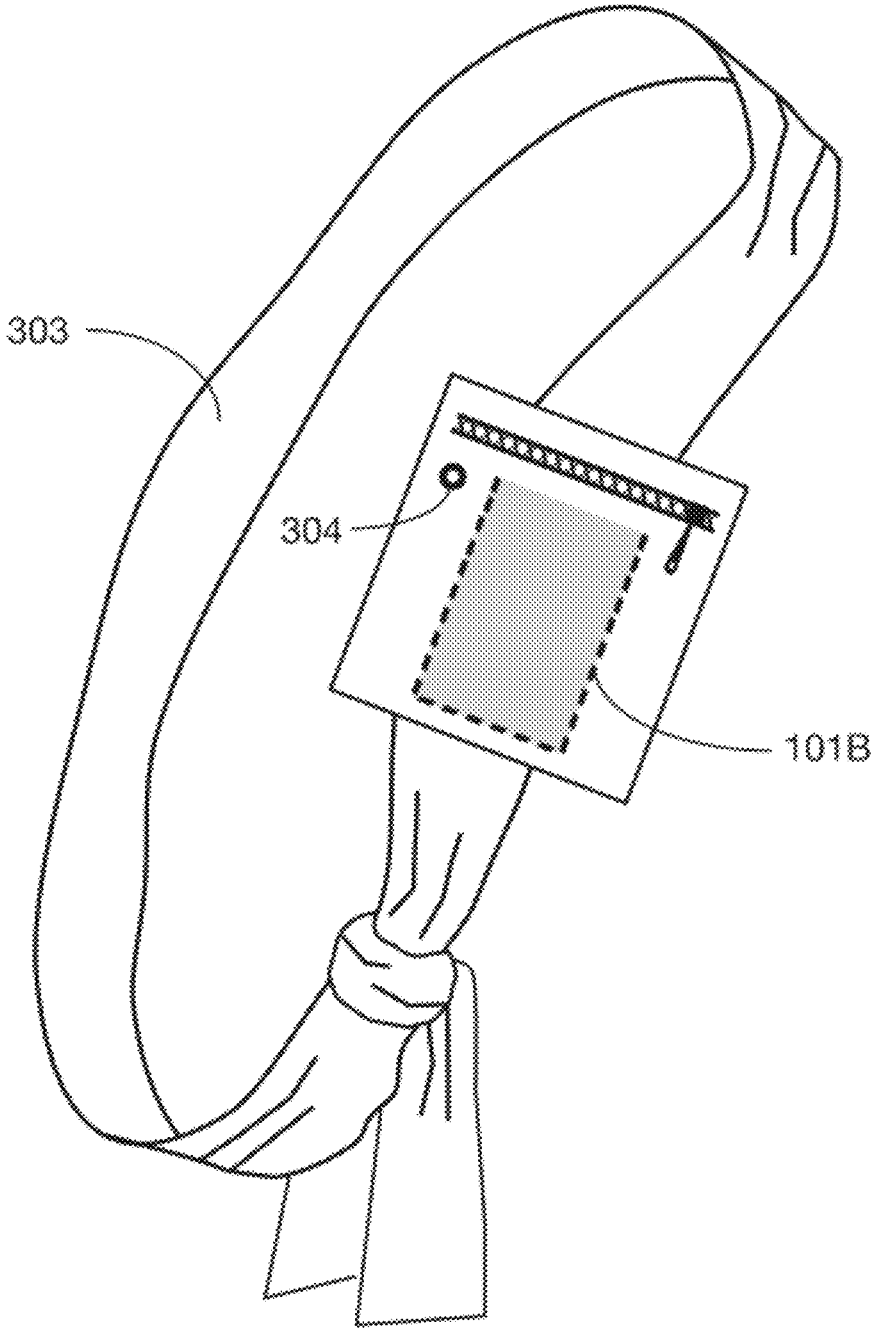
FIG. 6 is a perspective view of a window pocket sash.

In particular embodiments, a pocket 101 may be combined with (e.g., attached to) a standard belt 403. As shown in FIG. 5, the pocket 101 may include an opening 304 that may be sized to fit the cord of earphones or similar accessories for use with a wireless device stored within the scarf's pocket 101. The belt 403 may be adapted to be worn around a user's waist.

Window Pocket Sash

In particular embodiments, a pocket 101 may be combined with (e.g., attached to) a standard sash 303. The standard sash 303 may be adapted to be worn over a user's shoulder.

Detachable Window Pocket

In particular embodiments, a pocket may be adapted for selective removal from a particular garment. For example, a pocket may be disposed on a scarf and adapted to be selectively removed from and attached to the scarf. The selective removal of the pocket may be achieved via any suitable means (e.g., via a suitable hook-and-loop faster or zipper).

Window Pocket Scarf for Wireless Device with Multiple Cameras

In particular embodiments, a pocket may be adapted for use with a wireless device comprising multiple cameras. In such embodiments, the length of fabric may define additional openings that are adapted to align with each camera lens of the mobile device. Particular mobile devices may comprise a first camera lens on the rear of the mobile device and a second camera lens on the front of the mobile device. In particular embodiments, a window pocket scarf may be adapted to allow a user to operate both of the wireless devices' cameras while the wireless device is positioned within the pocket.

Reversible Window Pocket Scarf

In particular embodiments, the window pocket scarf may include a strip of fabric that is positioned to cover the rear of the pocket that holds the wireless device (e.g., the pocket may either not have a rear window, or the scarf may include an extra piece of fabric that selectively covers the rear window.) In such embodiments, a user may wear the window pocket scarf with the first opening facing outwardly to reveal the wireless device, or the user may wear the window pocket scarf with the first opening against the user's body to conceal the pocket and the wireless device.

Waterproof Window Pocket Scarf

In particular embodiments, the pocket may be substantially waterproof (e.g., waterproof). In such embodiments, the pocket is adapted to protect a wireless device that is disposed within the pocket from water.

Conclusion

Many modifications and other embodiments of the invention will come to mind to one skilled in the art to which this invention pertains having the benefits of the teachings presented in the foregoing descriptions and the associated drawings. For example, as will be understood by one skilled in the relevant field in life of this disclosure, the invention may take form in a variety of different mechanical and operational configurations. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

I claim:

1. An elongated, rectangular scarf comprising:

a first elongated, rectangular sheet of fabric that defines a front surface of said elongated, rectangular scarf and that defines a first opening that is covered by a first window, said first opening being adjacent a particular end of said elongated, rectangular scarf;

a second elongated, rectangular sheet of fabric that at least partially defines a rear surface of said elongated, rectangular scarf and that defines a second opening that is covered by a second window, said rear surface being opposite said front surface and said second window at least partially overlapping said first window adjacent said particular end of said scarf, wherein said first and second elongated, rectangular sheets of fabric are sewn together about their respective perimeters to form said elongated, rectangular scarf;

a pocket formed between said front and rear surfaces of said elongated, rectangular scarf, said pocket being disposed adjacent said particular end of said elongated rectangular scarf and said pocket being defined at least partially by said first window and said second window, wherein:

said pocket is sized and adapted so that when a wireless device is disposed within said pocket in a particular position;

(A) said first window aligns with a display screen located on a front surface of the wireless device;

(B) said second window aligns with a camera lens located on a rear surface of the wireless device;

said first and second windows are adapted so that when said wireless device is disposed within said pocket in the particular position, a user may operate said wireless device, via said display screen, through said first window to cause said wireless device to use said camera lens to take a photograph through said second window;

said scarf is configured for, while said wireless device is disposed within said pocket within said particular position, allowing a user who is wearing said elongated scarf so that a central portion of said elongated scarf is wrapped around said user's neck, to reorient said scarf from:

(A) a first orientation in which the particular end portion of said scarf, which includes said pocket is hanging substantially freely adjacent said user, and said wireless device is upside down, to (B) a second orientation in which said particular end portion of said scarf has been elevated and said wireless device is right side up.

2. The scarf of claim 1, wherein:

said scarf defines an elongated access opening; and said elongated access opening is adapted to allow said user to selectively insert said wireless device into, or remove said wireless device from, said pocket.

3. The scarf of claim 1, wherein said first window comprises at least one sheet of transparent material that is adapted to allow a user to operate said wireless device through said at least one sheet of transparent material when said wireless device is disposed within said pocket.

4. The scarf of claim 3, wherein:

said second window is sufficiently transparent to allow a user to use said wireless device to take a clear picture through said second window when said wireless device is disposed within said pocket.

5. The scarf of claim 1, wherein:

said second window is smaller than said first window and is positioned adjacent a distal end of said first window.

6. The scarf of claim 1, wherein said second window is sufficiently transparent to allow a user to use said wireless device to take a clear picture through said second window when said wireless device is disposed within said pocket.

7. The scarf of claim 1, wherein:

said first window comprises a first lateral side edge and a second lateral side edge;

said second window comprises a first lateral side edge and a second lateral side edge;

said first lateral side edge of said first window is parallel to, and superimposed over, said first lateral side edge of said second window; and said second lateral side edge of said first window is parallel to, and superimposed over, said second lateral side edge of said second window.

8. The scarf of claim 1, wherein:

said scarf is configured to allow a user who is wearing said scarf, while said wireless device is disposed within said pocket within said particular position, to reorient said scarf so that said user may operate said wireless device through said first window to cause said wireless device to take a picture through said second window.

9. The scarf of claim 1, wherein said pocket is substantially waterproof.

* * * * *